United States Patent [19]

Tsui

[11] Patent Number: 4,528,090

[45] Date of Patent: Jul. 9, 1985

[54] OIL SHALE BENEFICIATION BY SIZE REDUCTION COMBINED WITH HEAVY MEDIA SEPARATION

[75] Inventor: Tien-Fung Tsui, Richardson, Tex.

[73] Assignee: Mobil Oil Corporation, New York, N.Y.

[21] Appl. No.: 542,821

[22] Filed: Oct. 17, 1983

[51] Int. Cl.[3] ..... B03B 9/02

[52] U.S. Cl. ..... 209/2; 209/172; 208/11 LE; 241/24

[58] Field of Search ..... 208/11 R, 11 LE; 209/163, 171, 172, 172.5, 2, 12, 17, 173; 241/24

[56] References Cited

U.S. PATENT DOCUMENTS

| | | | |
|---|---|---|---|
| 4,342,639 | 8/1982 | Gagon | 208/11 LE |
| 4,348,274 | 9/1982 | Guerre | 209/172.5 X |
| 4,441,984 | 4/1984 | Guerre | 208/11 LE |

*Primary Examiner*—Charles Hart

*Attorney, Agent, or Firm*—Alexander J. McKillop; Michael G. Gilman; Charles A. Malone

[57] ABSTRACT

This invention discloses a method of enriching raw oil shale by crushing and pulverizing raw oil shale or similar oil bearing materials into smaller, lean oil particles and larger, oil rich particles; floating the larger, oil rich particles in a heavy media organic liquid which causes the oil rich lighter particles to float on the surface and causes the heavier, mineral containing particles to sink. The floating larger, oil rich particles thus obtained contain increased percentages of oil bearing constituents.

16 Claims, 5 Drawing Figures

OIL SHALE BENEFICIATION BY SIZE REDUCTION COMBINED WITH HEAVY MEDIA SEPARATION

BACKGROUND OF THE INVENTION

1. Field of the Invention

This invention relates to a beneficiation process for upgrading mined oil shale prior to retorting for recovery of the oil.

2. Description of the Prior Art

Large deposits of oil shale are found in many locations throughout the world, and extensive efforts have been undertaken to develop oil shale as a source of hydrocarbon products. The term "oil shale" is widely used to refer to a layered sedimentary formation containing an organic material known as kerogen which may be decomposed by heating to produce gaseous and liquid hydrocarbon products. Such processing of the oil shale may be conducted in place in the deposit (in situ) or the oil shale may be mined by conventional mining methods and the oil shale ore processed by retorting on the surface. In such retorting, particles of mined oil shale are heated over a period of time to an appropriate temperature of yield gaseous and liquid hydrocarbon fractions. Two examples of such retorts and retorting processes are those described in U.S. Pat. Nos. 3,821,353, and 4,133,741 granted to Weichman and Knight et al. respectively.

Because of the high temperatures required in known retorts and retorting processes for obtaining hydrocarbon values from oil shale, and the resultant need for large amounts of energy to provide such heat, it is desirable to retort as little oil shale as possible to obtain each gallon of oil. To accomplish a reduction in the amount of heat required to retort oil shale, others have developed processes for the beneficiation of oil shale.

Such a process is described in U.S. Pat. No. 4,257,878 which was granted to Fishback et al. in which oil shale is beneficiated by increasing the oil content of the clay-bearing oil shale ore by subjecting the oil shale ore to an aqueous medium, agitating to disintegrate at least a portion of the clay, and separating the disintegrated clay from the remaining oil shale to yield an oil shale having a greater amount of recoverable hydrocarbon values per ton than the unprocessed oil shale ore.

Moudgil et al. disclosed in U.S. Pat. No. 4,169,045 a method for the separation of shale from run of mine (ROM) shale containing particles of shale and refuse, which comprised conditioning the ROM shale with a coupling agent capable of selectively coating the kerogen hydrocarbons in the particulate shale to the substantial exclusion of coating the non-hydrocarbonaceous refuse, which coupling agent was at least one carbolic acid, preferably containing from about five to about twenty-eight carbon atoms and a ketone. Combined with the coupling agent was a fluorescent dye in a quantity sufficient to make the coated particles of shale fluoresce upon excitation to a degree sufficient to distinguish the coated shale particles from the substantially non-coated refuse.

Fahlstrom teaches a method for treating shales in U.S. Pat. No. 4,176,042. Here, kerogen-containing shale is crushed and comminuted to a fineness sufficient to free kerogen and any sulphides present in said shale. To enable the shale to be finely-divided more readily, the crushed shale is subjected to a leaching treatment prior to final comminution thereof. Fahlstrom also taught the use of a density-separation process where a non-polar, water immiscible liquid was used. This liquid had a density of from about 1.3–1.5.

Rosar et al. via U.S. Pat. No. 3,973,734 disclosed a froth flotation method for separation of sodium compounds, principally nahcolite, dawsonite, trona, related authigenic sodium ores, and corresponding sodium compounds including sodium carbonate and sodium bicarbonate, from kerogen-type organics-containing rock, by use of sodium carbonate and/or sodium bicarbonate-containing brines having a basic pH ranging above about 7.0, preferably about 8.0–12.0, and recovering a sodium compound-rich fraction as a non-float portion and an organics-rich fraction as a float portion. Frothers, froth control agents and collection agents may be used separately or in combination. Single or multiple-stage flotation, with cleaning, conditioning, scavenging, reflotation, and combining of products might also be used. Feed ore end products may be screened to abrate the head or product assay. By this method, raw or retorted oil shale may be separated from sodium minerals and compounds obtained therein.

B. M. Moudgil and N. Arbiter have given a comprehensive overview regarding oil shale beneficiation in their article entitled "Oil Shale Beneficiation for Above Ground Retorting." This article appeared in *Mining Engineering* at pages 1336–38 (Sept. 1982).

Applicant in the present invention has determined that oil shale can be enriched and the amount of shale oil recovered can be optimized by controlling the size of the particles for retorting purposes.

Utilizing Applicant's invention results in lower raw oil shale processing costs and lower costs in retorting the oil shale. These lower costs result from energy savings during the processing and retorting of raw oil shale.

SUMMARY OF THE INVENTION

This invention is directed to a method for crushing and pulverizing raw oil shale to a small particle size including relatively smaller, oil lean particles and larger, oil rich particles; subsequently floating said larger particles in a non-polar liquid having a specific gravity which causes the oil rich particles to float and the oil lean particles to sink; and thereafter separately recovering the floating particles and the submerged particles from said liquid.

An embodiment of this invention is directed to a method for enriching raw oil shale or other similar oil containing materials by crushing and pulverizing raw oil shale into a small particle size including relatively smaller, oil lean particles of about 1/16 inch (0.16 cm) or less in diameter and larger, oil rich particles of about ⅜ inch (1.0 cm) or less in diameter; floating the rich oil particles of about ⅜ inch (1.0 cm) or less in diameter in a non-polar liquid having a specific gravity which causes the oil rich particles to float and the oil lean particles to sink; and separately recovering the floating particles and the submerged particles from said liquid.

DESCRIPTION OF THE PREFERRED EMBODIMENTS

Figure 5:
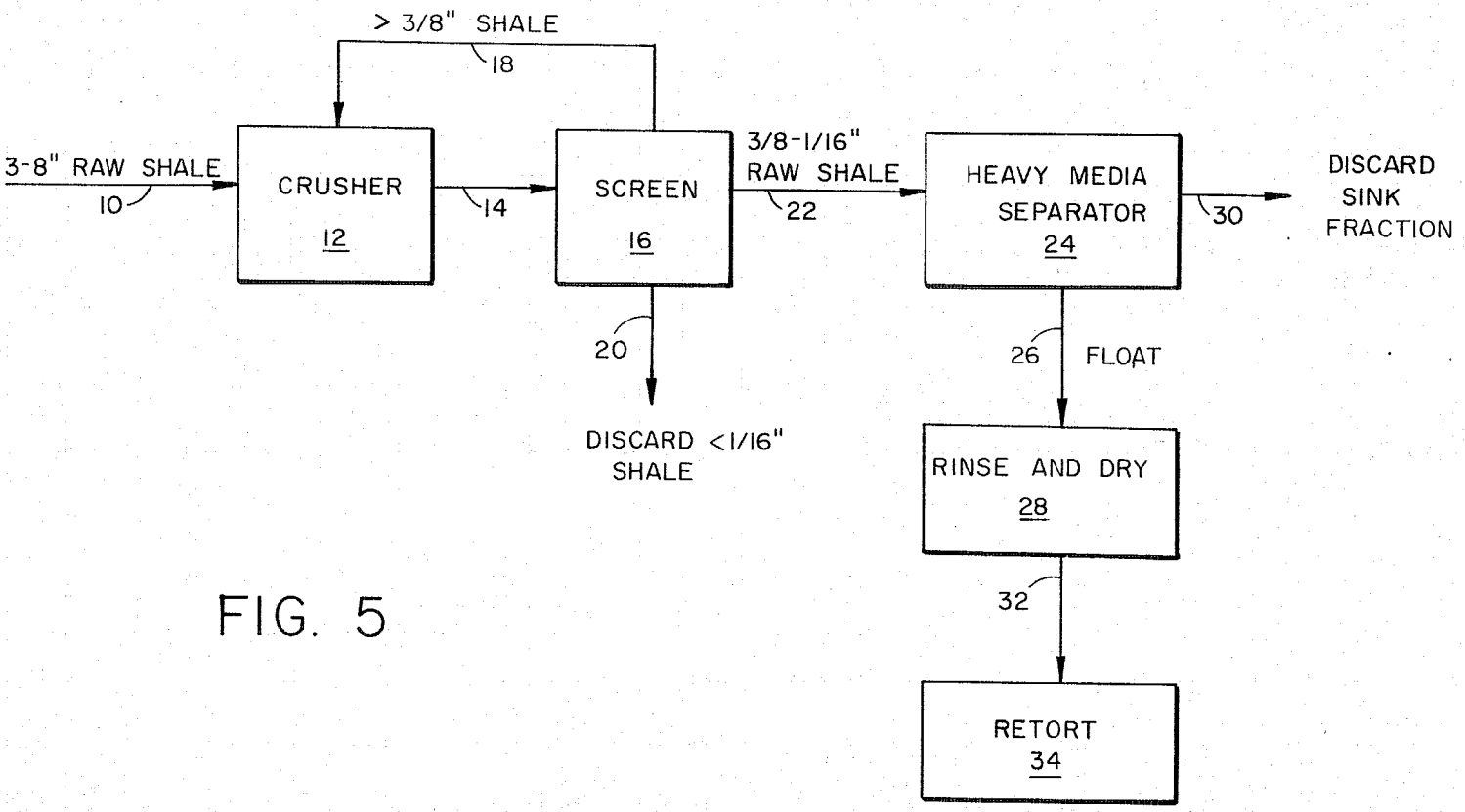
FIG. 5 is a schematic representation of the preferred embodiment of this invention.

Referring to FIG. 5, raw shale of approximately 3 to 6 inches (7.6–15.2 cm) is introduced into the crusher (12) via line (10). Crushers which can be used in the process of this invention include ones described by Fisher in U.S. Pat. No. 2,587,609 and by Blythe described in U.S. Pat. No. 3,614,000. Both of these patents are hereby incorporated by reference in their entireties. After leaving the crusher (12), the shale is fed onto a screen (16) which sizes and grades the shale. Small, lean shale particles which are of a size less than about 1/16 inch (0.16 cm) are discarded via line (20). Shale which is larger than about ⅜ inch (1.0 cm) is removed from the screen (16) and transported via line (18) into the crusher (12) for further crushing and pulverizing. Larger shale particles which are of a size of about ⅜ inch to about 1/16 inch (1.0 cm–0.16 cm) are removed from the screen (16) and led by line (22) into the heavy media separator (24). This separator contains halogenated hydrocarbons having a specific gravity range of from about 1.6 to about 2.3, preferably about 2.0–2.1. Chlorinated and brominated hydrocarbons are preferred. The shale which floats on the heavy media liquid is removed from the heavy media separator (24) via line (26) to a rinser and dryer (28). Afterwards, the shale which is of a particle size of about ⅜ inch to about 1/16 inch (1.0 to 0.16 cm) is removed from the rinser and dryer (28) by line (32) and fed into an oil shale retort (34). A retort which can be used for this purpose is described in U.S. Pat. No. 3,960,702 which was issued to V. D. Allred and is hereby incorporated by reference in its entirety. The heavier lean particles which sank to the bottom of the heavy media separator (24) are removed therefrom via line (30) and discarded.

In an another embodiment of this invention, the small fines which are less than about 1/16 inch (1.0 cm) which have been obtained from line (20) as well as the heavier lean particles from line (30) may be pelletized and fed into the retort for the further reclamation of kerogen containing products.

In yet another embodiment of this invention the lean particles or small fines which are about 1/16 inch (1.0 cm) or less can be fed into a pulverizer then to a froth floatation process as described in U.S. Pat. No. 4,176,042 to Falstrom et al. for further reclamation of useful materials therefrom. The Falstrom et al. patent is hereby incorporated by reference in its entirety.

To demonstrate the beneficial results obtainable by this process, Colorado and Kentucky oil shales were initially crushed into a size of about 3 to 6 inches or 7.62 to 15.24 cm. Afterwards the shales were crushed in a Holmes crusher (Holmes model 201, size 7×6), followed by grinding in a Holmes pulverizer (Holmes model 500). The openings of the screen plates used in the Holmes crusher were about ⅜ inch or about 1.0 centimeters. Openings of the screen plates used in the pulverizer were 0.63 inches or about 0.16 centimeters. After crushing and grinding, the two shales were sieved into six size fractions each and tested for total organic carbon (TOC) and specific gravity (SG). These values were then plotted in FIGS. 1 and 2 along with calculated oil yields versus the size of the sieve openings.

Figure 1:
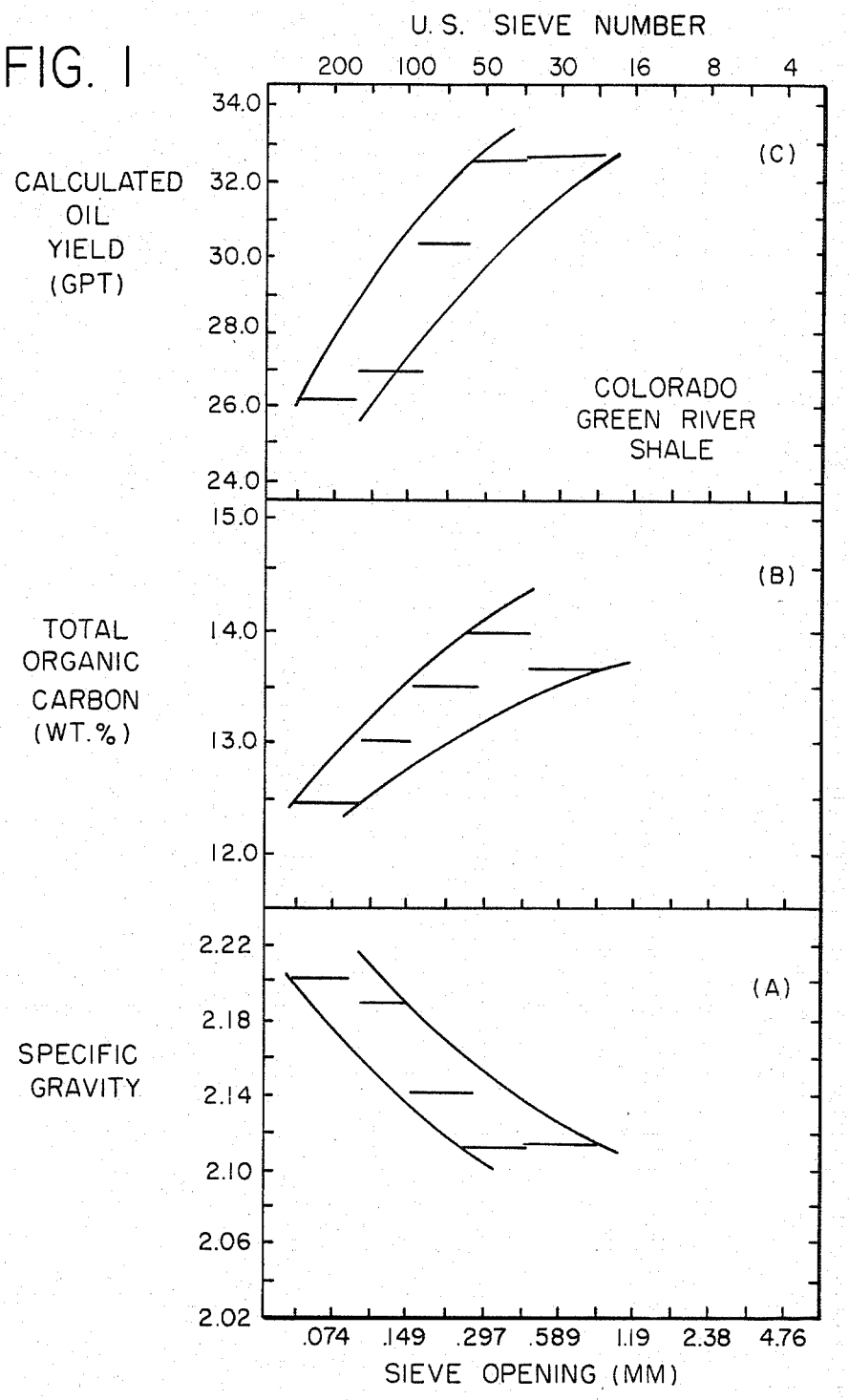
FIG. 1A shows graphically the relationship between the specific gravity of the crushed shale and the particle size of the Colorado Green River shale.
FIG. 1B graphically depicts the relationship between the total organic carbon (wt. %) of the shale and the particle size of the Colorado Green River shale.
FIG. 1C represents graphically the relationship between the calculated oil yield in gallons per ton ("GPT") and the particle size of the Colorado Green River shale.
Figure 2:
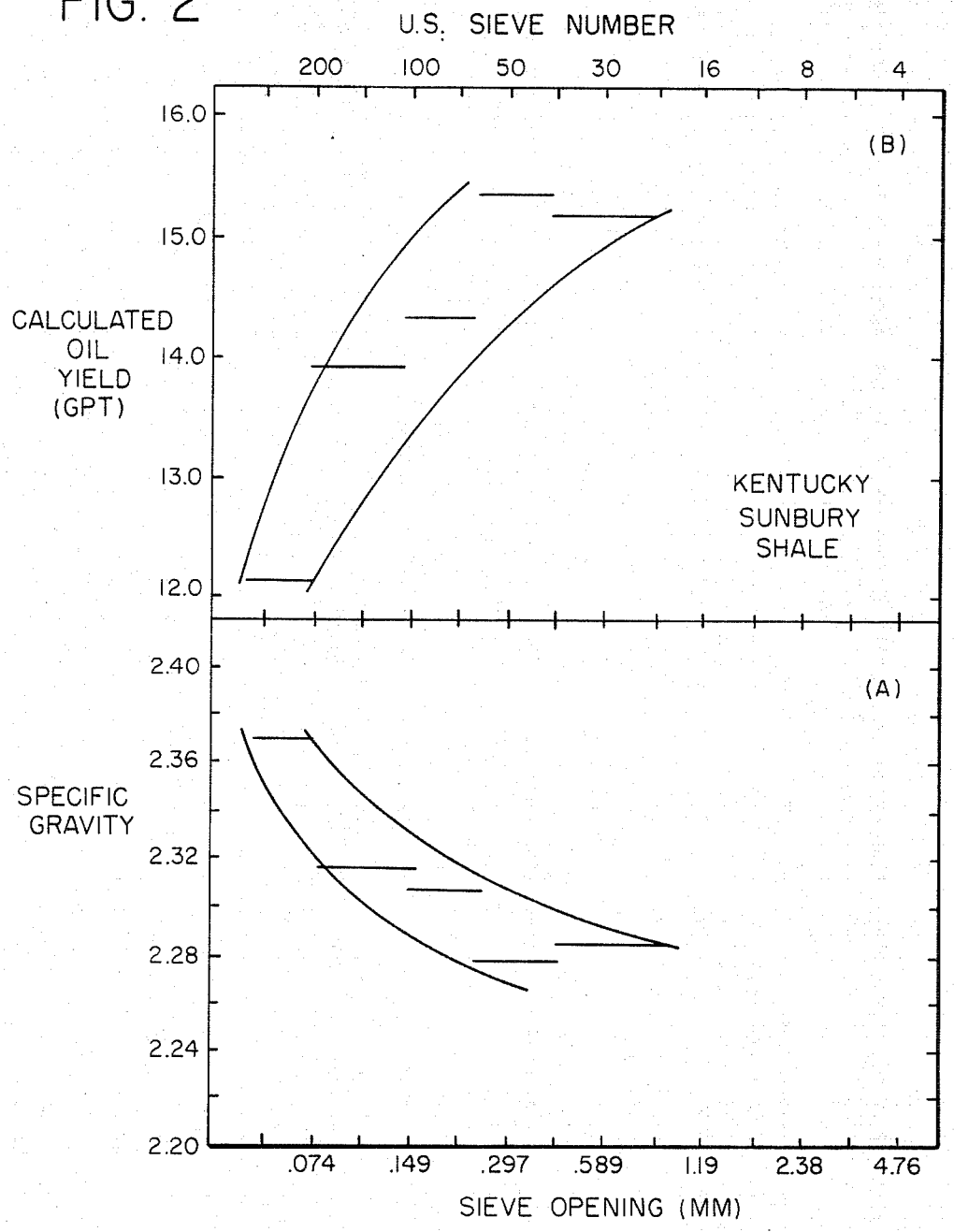
FIG. 2A shows graphically the variations between the specific gravity of Kentucky Sunbury shale and the particle size of the shale.
FIG. 2B is a graphic representation depicting the variation between the calculated oil yield ("GPT") of Kentucky Sunbury shale and the particle size of the shale.

FIGS. 1 and 2 show that with decreasing shale particle size, there is an increase in the specific gravity of the shale, but a decrease in the total organic carbon and oil content of the shale. The greater specific gravity in the smaller sized particles is due to the lower organic carbon content of the small size fractions. In the case of Colorado Green River shale with initial oil yield somewhere around 20 gallons per ton ("GPT"), FIG. 1C indicates that after crushing, pulverizing and grinding, the shale has been separated into relatively enriched larger size fractions and relatively depleted smaller size fractions. Kentucky Sunbury shale, whose initial grade is around 14 GPT, (FIG. 2B), after crushing, was separated into leaner, smaller size fractions and richer, larger size fractions.

Such a preferential grade separation with varying particle sizes can be attributed to the difference in the mechanical properties between organic and mineral particles. Organics have been known to be somewhat resilient. When crushed, organics probably tend to bend and deform but remain somewhat unsusceptible to breaking. Inorganics are comparatively more brittle and therefore, easier to break in all directions. As a result, when oil shales are crushed, more minerals wind up in the fine fractions which leave the coarse, large fractions relatively rich in organics.

Knowing that the efficiency of beneficiation by heavy media separation or the "sink-float" method increases with the grade of input shale, it is obviously advantageous to send shale of higher grade through the beneficiation circuit. Since there is a preferential grading of oil shales by size during crushing operations, lean shales can be upgraded by strategic crushing and screening to yield a higher grade fraction. The combination of these two steps indicate that a two-stage beneficiation process is advantageous. First the mine-run shales are separated by crushing and screening (size reduction) into a rich coarse fraction and a lean fine fraction. Then the rich coarse fraction is further upgraded by heavy media (sink-float) separation.

Figure 3:
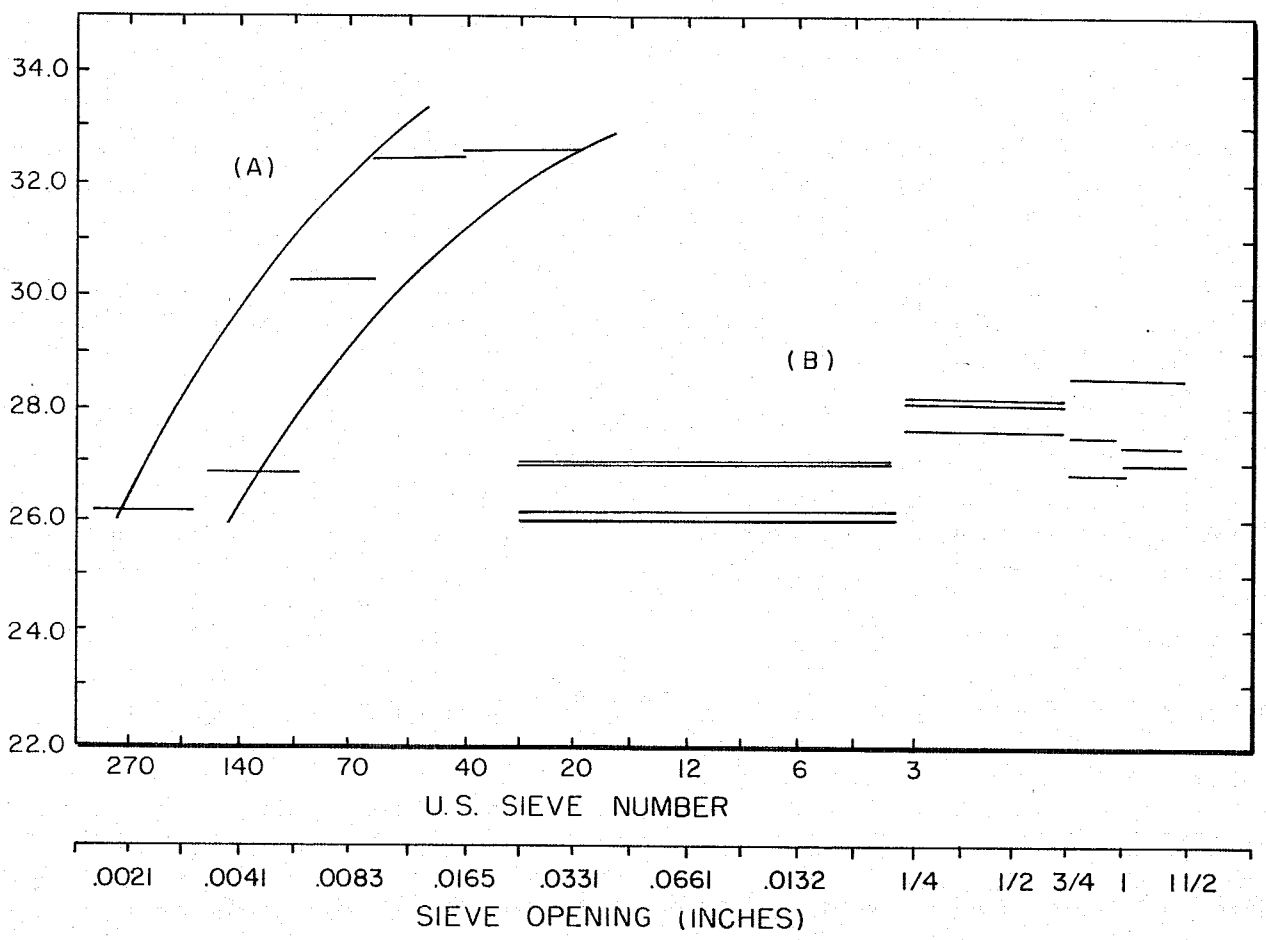
FIG. 3 illustrates graphically the relationship between oil yield and particle size of Colorado Green River shale based upon data obtained from two series of tests, (A) and (B).

Of course, at some point it will become impossible to increase oil yield with increased particle size. At some point this rising trend will drop first and eventually flatten out at above certain particle size. It can be visualized that when shale particles become larger than the maximum dimensions of organics, the resilient property of organics in keeping them from entering fine fractions no longer plays an important and effective role. This implies that, the oil yield of a 3" sized shale might not be much different from that of a 1" sized shale from the same source. To demonstrate this point, data obtained from a different set of experiments can be used. Each of four batches of oil shale samples were screened into four size fractions, $1\frac{1}{2}''\times 1''$, $1''\times\frac{3}{4}''$, $\frac{3}{4}''\times\frac{1}{4}''$ and $\frac{1}{4}''\times 28$ mesh. Each size fraction was then analyzed for its oil yield in terms of its Fisher Assay. FIGS. 3A and B are plots of all these four sets of data. This data varied randomly and no clear trend was demonstrated. However, compared to the rather steep trend observed for the smaller particle size region in FIG. 3A, it is reasonable to conclude that the data over the larger sized region has an overall flatter appearance. Since the samples did not come from the same batch as these samples used in the first experiment, nor had they been prepared in the same manner, these two sets of data may not be compared directly on an absolute base. However, the trends are of significance here. FIG. 3B shows that the trend of the second data set is not inconsistent with our earlier prediction, that is, the rising trend of increasing oil content with increasing particle size would drop and flatten out. In other words, the organic enrichment becomes effective only when the shale particles are down to certain size range, probably somewhere below about $\frac{3}{8}$–1/16 inch (1.0–0.16 cm).

Figure 4:
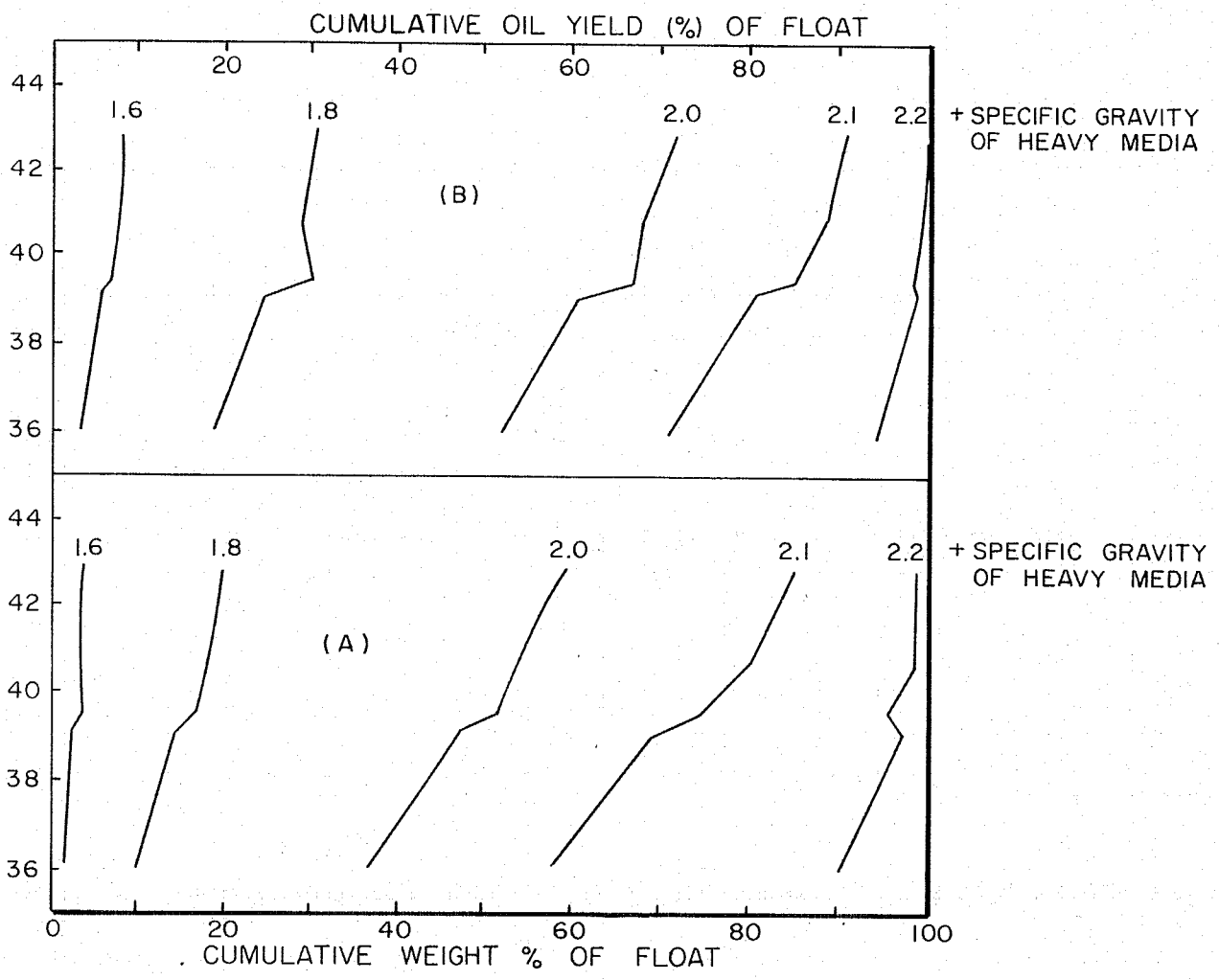
FIG. 4A shows graphically the cumulative weight percent of float products from heavy media separation tests as a function of initial shale grade.
FIG. 4B depicts graphically the cumulative oil yield of float products from heavy media separation tests as a function of initial shale grade.

The efficiency of oil shale beneficiation is related to the grade of input shale. This is evident when the test results of heavy media separation of oil shales of different grades are examined. The separating media (or heavy liquids) are preferably solvents of halogenated hydrocarbons that are combined to provide the desired specific gravity. The oil shale samples are immersed first in a bath of lower specific gravity to generate a float product and a sink product. This light bath has a specific gravity of about 1.6 to about 1.8 and is comprised of mixtures of halogenated hydrocarbons which include exemplary mixtures of carbon tetrabromide, carbon tetrachloride, and acetylene tetrabromide. The sink product is then immersed into the next heavier liquid bath to generate float and sink products. After rinsing and drying each float product, it is analyzed for its oil yield via a Fisher assay. FIG. 4A shows the relationship between shale grade in gallons per ton and the cumulative percent of float for each of the increasingly heavy media used. FIG. 4B depicts the relationship between shale grade and the cumulative oil yield of float. The trends seen in these two figures indicate that the higher the shale grade, the higher is the proportion of shale that floats or the higher is the cumulative oil yield of float. In other words, the efficiency of heavy media separation in upgrading oil shale increases with the initial shale grade. This is understandable since the richer is the shale grade the greater are the organic content and buoyancy. The slopes of the lines are greatest for those sink-float tests done at specific gravity of about 2.0 and 2.1. The largest increase in the efficiency of heavy media separation with increasing shale grade is manifested when a heavy media with specific gravity of about 2.0 or 2.1 is used.

From these test results it is shown that selecting an oil shale particle size of from about 1/16–$\frac{3}{8}$ inch (0.16–1.0 cm) minimizes the amount of energy required to obtain the optimum amount of oil from a given amount of oil shale without retorting unnecessarily the mineral portion of the oil shale.

Obviously, many other variations and modifications of the invention, as previously set forth, may be made without departing from the spirit and scope of this invention, as those skilled in the art will readily understand. Such variations and modifications are considered to be within the purview and scope of the appended claims.

What is claimed is:

1. A method for enriching raw oil shale or other similar oil containing materials comprising:

(a) crushing and pulverizing raw oil shale to a small particle size including relatively smaller, mineral rich, oil lean particles and larger, oil rich particles;

(b) floating said larger particles in a non-polar liquid which specific gravity causes the oil rich particles to float and the oil lean particles to sink; and (c) separately recovering the floating particles and the submerged particles from said liquid.

2. A method as recited in claim 1 where in step (b) the specific gravity of the liquid into which the larger particles are floated is from about 1.6 to about 2.22.

3. A method as recited in claim 1 where in step (b) the specific gravity of the liquid into which the larger particles are floated is from about 2.0 to about 2.1.

4. A method as recited in claim 4 where in step (b) the liquid is a halogenated hydrocarbon.

5. A method as recited in claim 4 where the halogenated hydrocarbon is carbon tetrachloride.

6. A method as recited in claim 4 where the halogenated hydrocarbon is carbon tetrabromide.

7. A method as recited in claim 4 where the halogenated hydrocarbon is acetylene tetrabromide.

8. A method as recited in claim 1 where in step (a) the raw oil shale is fed onto a screen for sizing and grading after being crushed and pulverized.

9. A method for enriching raw oil shale or other similar oil containing materials comprising:

(a) crushing and pulverizing raw oil shale into a small particle size including relatively smaller, mineral rich, oil lean particles of about 1/16 inch (0.16 cm) or less in diameter and larger, oil rich particles of about $\frac{3}{8}$ inch (1.0 cm) or less in diameter;

(b) floating the rich oil particles of about $\frac{3}{8}$ inch (1.0 cm) or less in diameter in a non-polar liquid which specific gravity causes the oil rich particles to float and the oil lean particles to sink; and (c) separately recovering the floating particles and the submerged particles from said liquid.

10. A method as recited in claim 9 where in step (b) the specific gravity of the liquid into which the larger particles are floated is from about 1.6 to about 2.22.

11. A method as recited in claim 9 where in step (b) the specific gravity of the liquid into which the larger particles are floated is from about 2.0 to about 2.1.

12. A method as recited in claim 9 where in step (b) the liquid is a halogenated hydrocarbon.

13. A method as recited in claim 12 where the halogenated hydrocarbon is carbon tetrachloride.

14. A method as recited in claim 12 where the halogenated hydrocarbon is carbon tetrabromide.

15. A method as recited in claim 12 where the halogenated hydrocarbon is acetylene tetrabromide.

16. A method as recited in claim 9 where in step (a) the raw oil shale is fed onto a screen for sizing and grading after being crushed and pulverized.

* * * * *